US008432238B2

(12) United States Patent
Lagorsse et al.

(10) Patent No.: US 8,432,238 B2
(45) Date of Patent: Apr. 30, 2013

(54) MULTIPLE-MEMBRANE FLEXIBLE WALL SYSTEM FOR TEMPERATURE-COMPENSATED TECHNOLOGY FILTERS AND MULTIPLEXERS

(75) Inventors: Joël Lagorsse, Castanet Tolosan (FR); Michel Blanquet, Fonsorbes (FR); Emmanuel Hayard, Toulouse (FR)

(73) Assignee: Thales (FR)

( * ) Notice: Subject to any disclaimer, the term of this patent is extended or adjusted under 35 U.S.C. 154(b) by 279 days.

(21) Appl. No.: 12/778,919

(22) Filed: May 12, 2010

(65) Prior Publication Data

US 2010/0315180 A1 Dec. 16, 2010

(30) Foreign Application Priority Data

May 15, 2009 (FR) ..... 09 02369

(51) Int. Cl.
*H01P 1/207* (2006.01)

(52) U.S. Cl.
USPC ..... 333/234; 333/208; 333/233

(58) Field of Classification Search ..... 333/208, 333/212, 232, 229, 234, 135, 126, 233
See application file for complete search history.

(56) References Cited

U.S. PATENT DOCUMENTS 3,121,205 A * 2/1964 Foss ..... 333/233
3,720,889 A * 3/1973 Gale ..... 333/232
4,488,132 A * 12/1984 Collins et al. ..... 333/229
4,677,403 A * 6/1987 Kich ..... 333/229
5,428,323 A 6/1995 Geissler et al.
5,867,077 A * 2/1999 Lundquist ..... 333/208
6,750,739 B2 6/2004 Enokihara et al.
6,960,969 B2 11/2005 Brevart et al.
7,453,337 B2 11/2008 Lagorsse et al.
7,671,708 B2 3/2010 Lagorsse et al.
2008/0068111 A1 3/2008 Hesselbarth
2008/0315974 A1 12/2008 Lagorsse et al.

* cited by examiner

*Primary Examiner* — Stephen Jones
(74) *Attorney, Agent, or Firm* — Baker & Hostetler, LLP

(57) ABSTRACT

The present invention relates to a flexible cap system optimized for thermally-compensated technology microwave resonators. More specifically, this invention proposes a multiple-membrane flexible wall system for thermally-compensated filters and OMUX. The use of a multi-membrane flexible wall, in particular as sealing cap for a resonant cavity of an OMUX channel, makes it possible: to reduce the thermal resistance of the flexible wall, while maintaining an equivalent level of mechanical stresses exerted on said wall for a given displacement; or to reduce the mechanical stresses exerted on the flexible wall for a given displacement, while maintaining one and the same thermal resistance for said wall; or to increase the deformation of the flexible wall by maintaining an equivalent level of mechanical stresses and by maintaining an equivalent thermal resistance.

17 Claims, 10 Drawing Sheets

MULTIPLE-MEMBRANE FLEXIBLE WALL SYSTEM FOR TEMPERATURE-COMPENSATED TECHNOLOGY FILTERS AND MULTIPLEXERS

CROSS-REFERENCE TO RELATED APPLICATIONS

This application claims priority to foreign France patent application No. 0902369, filed on May 15, 2009, the disclosure of which is hereby incorporated by reference in its entirety.

FIELD OF THE INVENTION

The present invention relates to the microwave resonators generally used in the field of terrestrial or space telecommunications.

It relates to a flexible wall system for microwave filters with resonant cavity, equipped with a mechanical temperature compensation device.

BACKGROUND OF THE INVENTION

This invention proposes a solution to the problem of the thermomechanical stresses encountered in the flexible portions, subject to temperature-induced deformation, of the filters and of the multiplexers, of the known type called OMUX (Output Multiplexer), with thermally-compensated technology resonant cavity and high power.

Generally, and hereinafter in the description and in the claims, the expression "thermally-compensated technology" is used to mean any technology that aims to deform a resonant cavity by temperature so as to compensate the volume variation of said resonant cavity, said volume variation being induced by temperature changes, so as to keep the resonance frequency of the cavity at the desired value. This value is generally predefined in ambient temperature conditions in the region of 20° C.

It will be recalled that a microwave resonator is an electromagnetic circuit tuned to let energy at a precise resonance frequency pass. The microwave resonators can be used to produce filters in order to reject the frequencies of a signal located outside the pass band of the filter.

A resonator takes the form of a structure forming a cavity, called resonant cavity, the dimensions of which are defined to obtain the desired resonance frequency.

Thus, any change to the dimensions of the cavity that introduce a change of volume of said cavity will cause a shift in its resonance frequency and, consequently, a change in its electrical properties.

The changes in the dimensions of a resonant cavity may be due to expansions or contractions of the walls of the cavity caused by temperature changes, which become all the more significant if the thermal expansion ratio of the material increases, and/or as the temperature variation increases.

A number of thermo-compensation techniques are known.

These techniques rely more often than not on the combination of parts involved in the structure of the cavity itself and that are made of materials with different thermal expansion ratios, one of the ratios being much lower than the other. The parts are arranged in such a way as to generate temperature-induced displacements relative to one another by exploiting the thermoelastic differential effect. Coupled with a flexible wall, they cause a deformation in the sense of a volume reduction when the temperature increases, or a volume increase when the temperature decreases.

Conventionally, a first material with a very low thermal expansion ratio, such as Invar™, is used. The second material used is normally aluminium, a material that has a higher thermal expansion ratio than Invar and that has, in addition to a low density, a high thermal conductivity, making it particularly well suited to space applications.

Based on this same principle of the use of two materials with different thermal expansion ratios, there are various compensation devices external to the cavity, the role of which is to deform a flexible wall.

Some of these temperature-compensation devices are, for example, described in the Patent Applications EP1187247 and EP1655802.

In order to meet the increasingly strong constraints in arranging satellite payloads, vertical channel architectures, that is to say, for example, architectures that have superposed input and output cavities, have been developed. These architectures are particularly detrimental from the point of view of the thermal control of the channel.

Now, in a hot environment, that is to say at temperatures of the order of 85° C. in the field of space applications, and faced with increasingly high dissipated power levels, that is to say above 100 Watts dissipated in an OMUX filter, the compensated technologies may have usage limitations.

In practice, to meet the needs for compensation, that is to say for deformations beyond 200 microns of displacement at the centre of the cap, the cap must be made sufficiently flexible and deformable to keep the material in its elastic domain.

The flexibility can be obtained in the case of a circular cap by increasing the distance between the rigid circular portion at the centre and the outer rigid circular portion, or even by reducing the thickness of the membrane.

In both cases, this has the effect of making the cap more thermally resistive, and consequently greatly reducing the local thermal gradients, that is to say at the place of the flexible wall itself.

High gradients may be particularly detrimental, for example with the use of aluminium alloys with structural hardening, such as aluminium 6061, the mechanical properties of which can decrease very rapidly as a function of the temperature and the duration of exposure to this same temperature. The temperature, and therefore the thermal resistance, must consequently be limited.

Conversely, to favour the reduction of the thermal gradients in the membrane, the thickness of the flexible portion can be increased, or the distance between the rigid portion at the centre and the outer rigid circular portion can be reduced, but then, the flexibility of the cap reduces, and may consequently become incompatible with the need for deformation to achieve the requisite compensation.

A first solution could involve using more thermally conductive materials, but these are generally incompatible with regard to their mechanical properties, or even with regard to their thermoelastic properties in conjunction with the structure of the aluminium resonant cavity.

To reduce the thermal gradients, the most obvious solution involves increasing the thickness of the walls of the OMUX filters, in order to favour the heat flux conducted towards the thermal control system of the satellite payload.

Now, this solution may become prohibitive for the competitiveness of the product, particularly in space applications because of the resulting significant weight increase.

The present invention resolves these difficulties by proposing a system that is compatible with different compensation solutions, and that makes it possible to reduce the thermal gradient of a flexible cap by a significant factor, and one that affects the overall weight only by a few grams.

The present invention therefore complements the current thermo-compensation technologies for filters and OMUX with resonant cavities. It relates more specifically to the flexible caps of thermally-compensated OMUXs. The idea is to optimize the ratio between the thermal resistance and the deformability of said caps.

Thus, to obtain a lower thermal resistance of the flexible caps, while maintaining deformability, the invention proposes a multiple-membrane flexible wall system. This system may also make it possible to reduce the mechanical stresses for a given deformation, while retaining an equivalent thermal resistance, or even to increase the deformation for equivalent levels of mechanical stresses and thermal resistance, and therefore to maintain equivalent thermal gradients for a given dissipated power.

SUMMARY OF THE INVENTION

To this end, the subject of the invention is a flexible wall system for filter component or output multiplexer of thermally-compensated technology, said wall comprising at least two stacked distinct flexible membranes, and said flexible membranes each having a central region, an intermediate region and a peripheral region face to face, in which said flexible membranes are thermally and mechanically coupled to the central region and to the peripheral region, and not coupled to the intermediate region.

Preferentially, said flexible membranes are adapted to be distorted simultaneously.

In the flexible wall system according to the invention, said flexible membranes are made of a flexible, metallic or non-metallic material.

Said flexible membranes may be made of materials distinct from one another.

In a routine embodiment, said flexible membranes are made of aluminium.

In another embodiment, each membrane is made of a combination of distinct materials.

Finally, each membrane may be made of a bimetallic strip material.

The various membranes of the flexible wall according to the invention are assembled by at least one of the following methods: screw-fastening; banding; brazing; thermal bonding; electrical welding.

Advantageously, a temperature-induced deformation of said flexible wall can be obtained by means of an external device.

Advantageously, a temperature-induced deformation of said flexible wall can be obtained by means of a deformation of at least one of said flexible membranes.

Advantageously, at least one of said flexible membranes comprises a bimetallic strip material, said bimetallic strip material participating in said temperature-induced deformation of the flexible wall.

Said flexible wall may comprise precisely two membranes.

Advantageously, said flexible wall comprises precisely three membranes.

Advantageously, each of said flexible membranes has a thickness of between two and four tenths of a millimetre.

Advantageously, a thermally-compensated technology filter comprising at least one resonant cavity sealed by a flexible cap device, said flexible cap consisting of a flexible wall according to the invention.

Advantageously, a thermally-compensated technology filter according to the invention may include a piston cooperating with said membranes, so as to allow for an optimization of the control of the volume of said resonant cavity.

Advantageously, a thermally-compensated technology output multiplexer comprising at least two channels, each comprising a resonant cavity sealed by a flexible cap device, said flexible cap consisting of a flexible wall according to the invention.

BRIEF DESCRIPTION OF THE DRAWINGS

Other features and advantages of the invention will become apparent from the following description, given in light of the appended drawings which represent.

DETAILED DESCRIPTION

Figure 1:
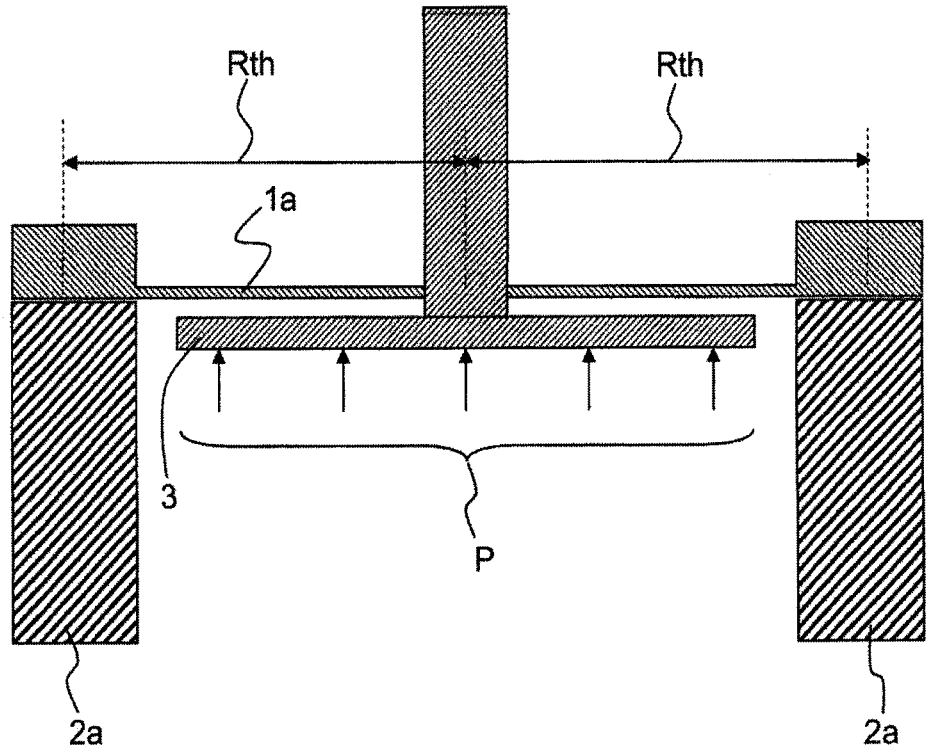
FIG. 1: simplified diagram of an OMUX channel having a flexible cap and a cavity comprising a piston, according to the state of the art.

FIG. 1 shows a partial diagram of an example of an OMUX channel. This channel comprises a cavity 2*a*, sealed by a flexible cap 1*a* which has an associated piston 3. When the OMUX is active, a certain power P is dissipated in the channel; a portion of this power P is dissipated on the surface of the piston. This dissipated power P raises the temperature within the channel. Now, it is essential to maintain a temperature level below a predetermined threshold. In effect, in the case of a flexible cap made of structurally hardened aluminium alloy, said cap undergoes, beyond a temperature threshold, a significant degradation of its mechanical properties that can be reflected in a loss of its elasticity leading to irreparable damage to the channel.

The flexible cap 1*a* has a thermal resistance Rth between the centre and the edge of said cap 1*a*. Thus, a hotter region tends to be formed at the centre of the cap 1*a*. Moreover, the temperature gradient is low if the thermal resistance is low. Consequently, it seems desirable to have a thermal resistance Rth that is as low as possible in order to avoid an excessive raising of the temperature at the centre of the flexible cap 1*a*.

However, the margin for manoeuvre is narrow: in practice, the thermal resistance of the cap 1*a*, for given geometrical dimensions, is linked to the nature of the material forming the cap 1*a*, typically aluminium, which has a certain thermal conductivity, and the thickness of the flexible cap. The thicker the cap is, the lower its thermal resistance becomes. However, it is essential for the flexible cap 1*a* to retain its mechanical characteristics, notably in terms of deformability, which prevents too great a thickness.

As a matter of fact, the thermomechanical constraints explained above constitute the main limiting factor for the field of use of the current temperature-compensated filters and OMUX technologies, and for the channel architecture. In practice, they:

- limit the power supported by the OMUXs,
- lead to an excessive weight on vertical channel architectures,
- impose a limitation on the use of certain electrical topologies requiring high compensation for a given temperature rise, and therefore a significant deformation of the cap.

The issue of the present invention is to propose a solution with which to reconcile a low thermal resistance and mechanical characteristics which allow a high deformability of the flexible cap of a channel within an OMUX.

In this context, FIGS. 2*a* to 5*b* show different implementations of the invention in the form of a multiple-membrane flexible cap intended for sealing a resonant cavity of an OMUX channel. It is essential to note that this preferred implementation of the invention is not the only possible implementation. In practice, the multiple-membrane flexible wall according to the invention is suitable for use as a flexible wall for any device based on temperature-compensated technology, and in particular devices of the filter or OMUX type.

Moreover, FIGS. 2*a*, 3*a*, 4*a*, 5*a* relate to banded multiple-membrane caps whereas FIGS. 2*b*, 3*b*, 4*b*, 5*b* relate to screwed multiple-membrane caps. It should be noted that the multiple membranes of the flexible walls according to the invention can be fixed to one another using other technological methods, in particular brazing, thermal bonding or even electrical welding. Said membranes are preferentially made of aluminium, but other appropriate materials can be used, such as, for example, copper. The use of different materials for the membranes of one and the same multiple-membrane flexible wall may also be considered.

Figure 2A:
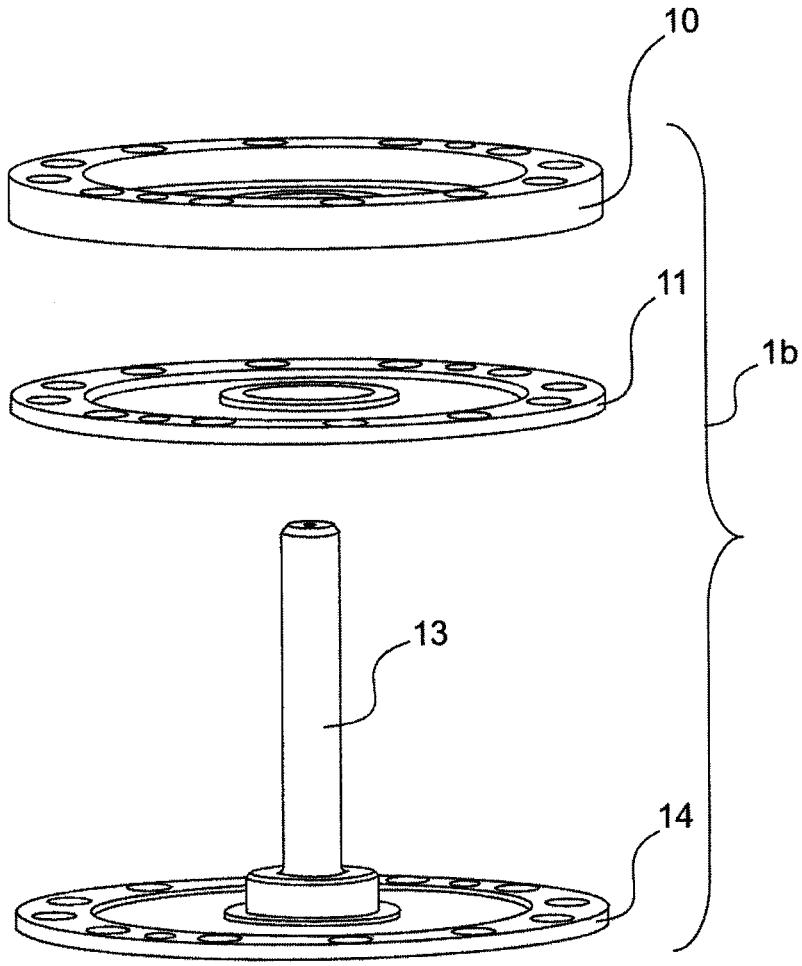
FIG. 2*a*: the exploded view of a cap with two membranes and a piston that are banded according to the invention.
Figure 2B:
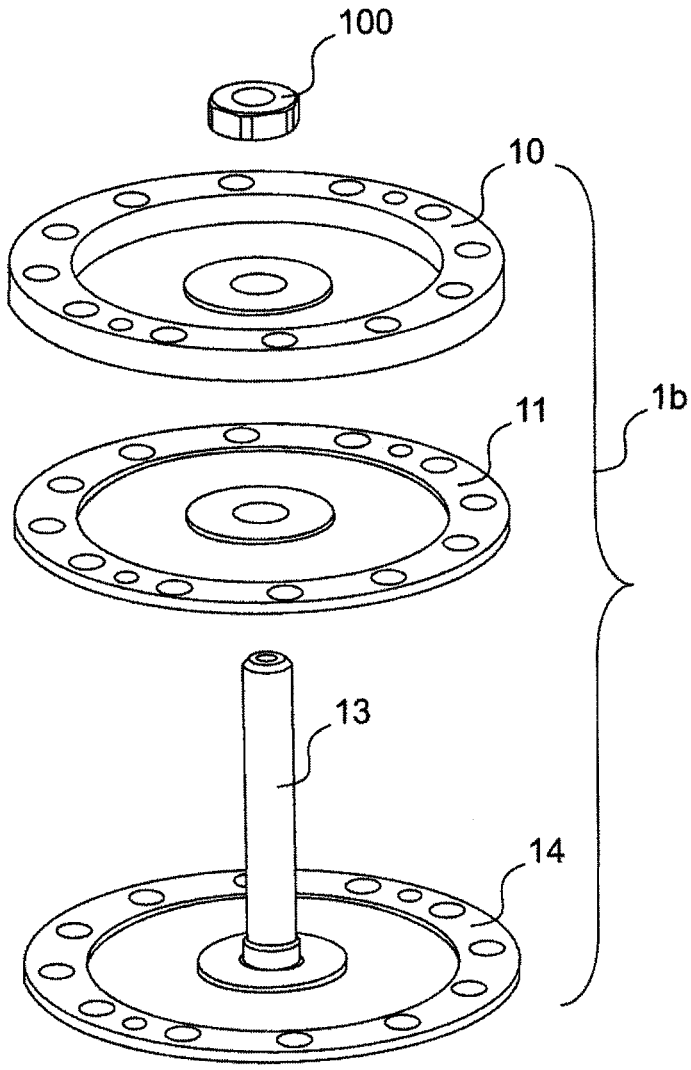
FIG. 2*b*: the exploded view of a cap with two membranes and a piston that are screwed together, according to the invention.

Thus, FIG. 2*a* shows the principle of the invention applied by way of example to a cap that can seal a resonant cavity of an OMUX channel. The flexible cap 1*b* in this case consists of a number of membranes 10, 11, associated with a piston 14. In FIG. 2*a*, the membranes 10, 11 are banded; in FIG. 2*b*, the principle is exactly the same, apart from the fact that the membranes 10, 11 are screwed together using the fixing means 100.

The use of a multiple-membrane flexible cap 1*b* provides a widely extended margin for manoeuvre in the context of optimizing the thermal resistance and the mechanical stresses that exist within a temperature-compensated technology cavity. In practice, it is possible to use flexible membranes 10, 11 of limited thickness, typically between 0.2 millimetres and 0.4 millimetres, for a cap with three membranes with an aggregate thickness of around 1.2 millimetres, so as to retain, for example, the same characteristics in terms of mechanical stresses as the flexible cap of FIG. 1, while reducing the overall thermal resistance of said cap 1*b*. To obtain this effect, the invention provides for the thermal and mechanical coupling together of the membranes 10, 11, but only over a portion of their surface area, as is clearly shown in FIGS. 3*a* and 3*b*.

Figure 3A:
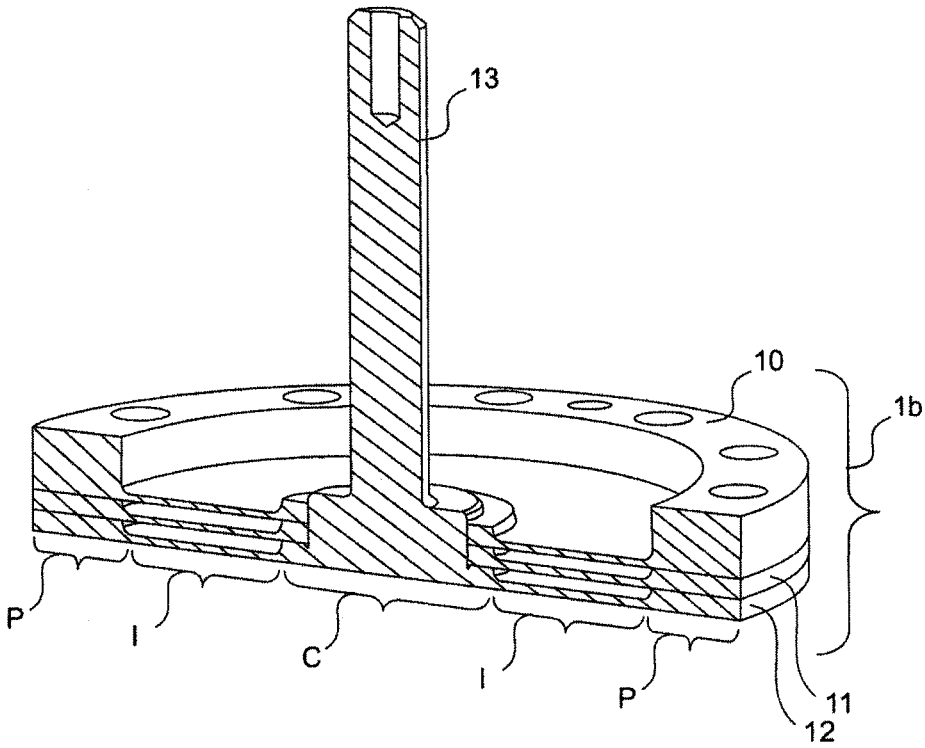
FIG. 3*a*: the transversal cross section of a cap with three banded membranes, according to the invention.
Figure 3B:
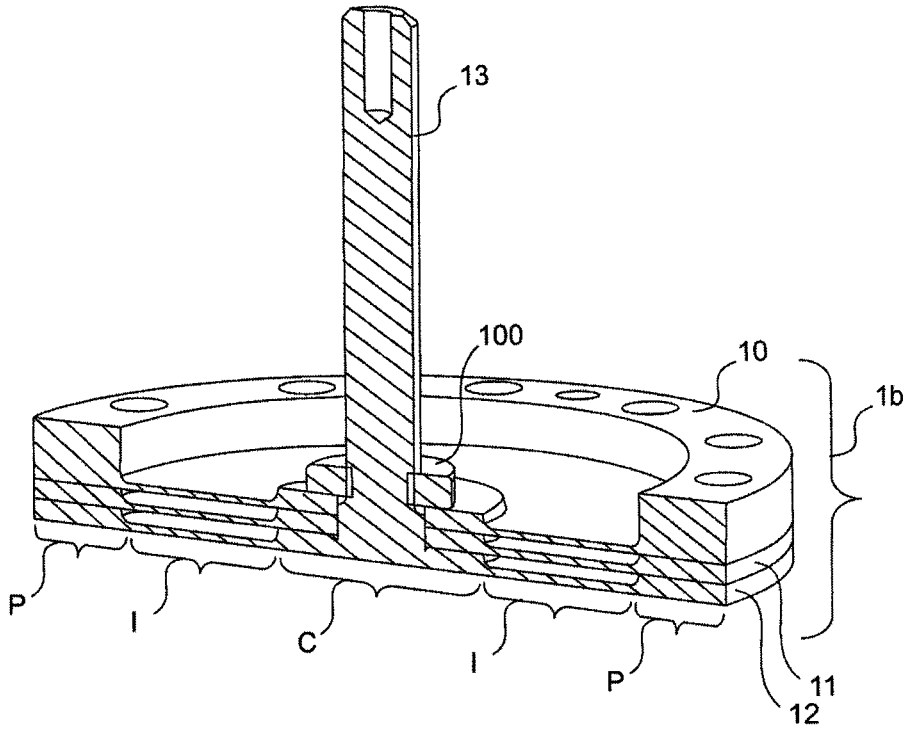
FIG. 3*b*: the transversal cross section of a cap with three membranes screwed together, according to the invention.

FIGS. 3*a* and 3*b* correspond to transverse cross sections of a multiple-membrane flexible cap 1*b*, according to the invention. The caps 1*b* represented in FIGS. 3*a*, 3*b* comprise a stack of three membranes 10, 11, 12 which leads to both an increase in the thermal section of the cap 1*b* and the level of mechanical stresses exerted on said caps 1*b* to be maintained.

It is important to note that, in accordance with what FIGS. 3*a* and 3*b* show, the three membranes 10, 11, 12 of the flexible cap 1*b* are linked together, by banding in FIG. 3*a* and by screw-fastening in FIG. 3*b*, in the central region C and in the peripheral region P, these central C and peripheral P regions being used to mechanically and thermally couple the membranes. Outside these regions, the membranes are disconnected, so that the multiple-membrane cap 1*b* acquires significant flexibility. Notably, there is an intermediate region I, between the central region C and the peripheral region P, on which the membranes 10, 11, 12 are decoupled. Thus, the thermal and mechanical coupling over the central C and peripheral P regions maximizes the mechanical stresses and minimizes the thermal resistance of the cap 1*b*, whereas the decoupling of the membranes in the intermediate region I gives the cap 1*b* its flexibility and versatility.

Figure 4A:
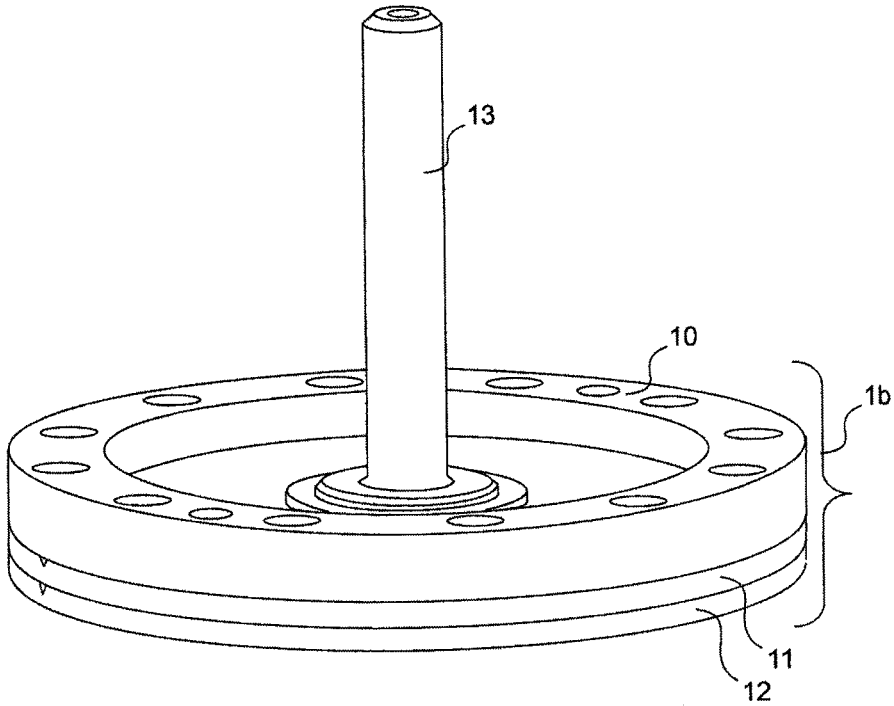
FIG. 4*a*: the three-dimensional view of a cap with three banded membranes, according to the invention.
Figure 4B:
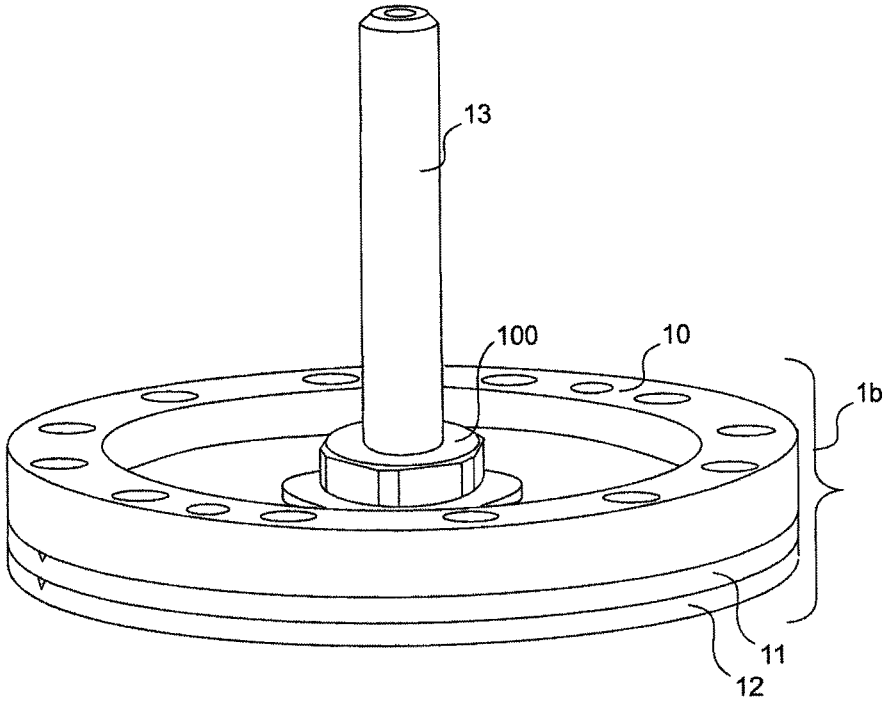
FIG. 4*b*: the three-dimensional view of a cap with three membranes screwed together, according to the invention.

FIGS. 4*a* and 4*b* show a cap 1*b* with three banded, respectively screwed membranes 10, 11, 12, conforming to the present invention.

Figure 5A:
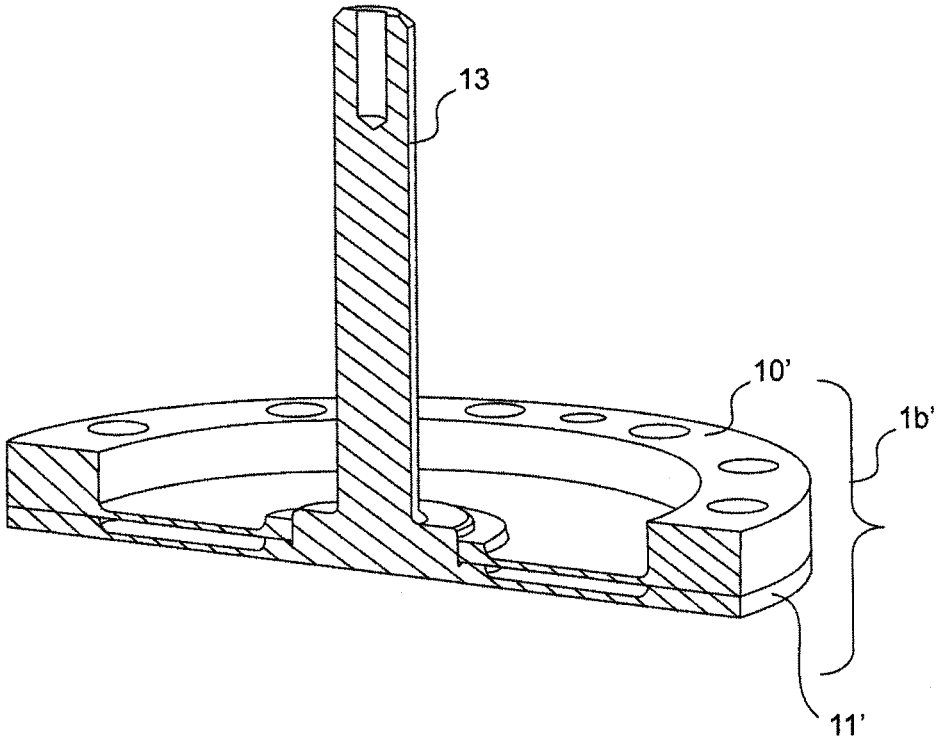
FIG. 5*a*: the transversal cross section of a cap with two banded membranes, according to the invention.
Figure 5B:
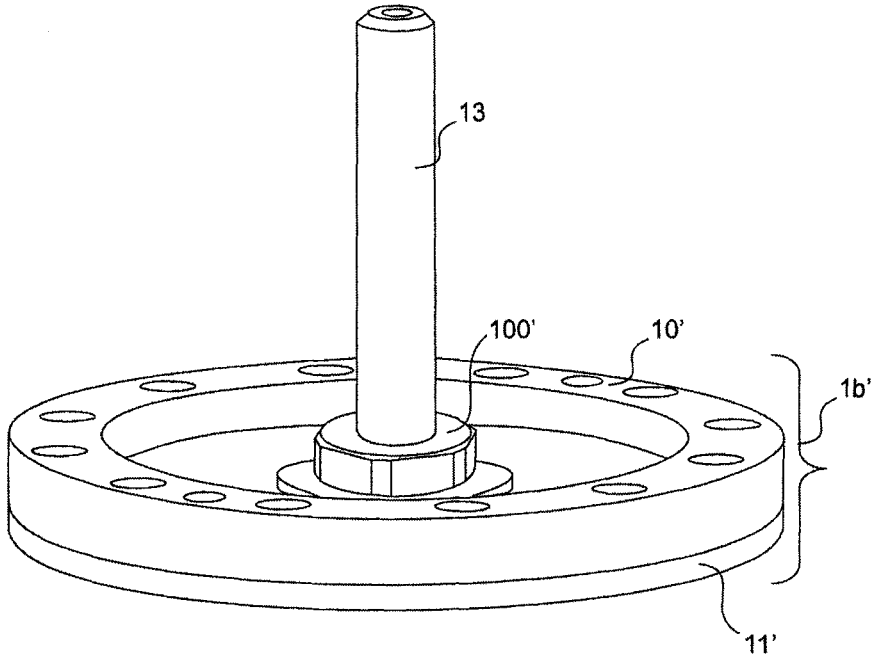
FIG. 5*b*: the three-dimensional view of a cap with two membranes screwed together, according to the invention.

FIGS. 5*a* and 5*b* show two other examples of an implementation of a multiple-membrane flexible wall according to the invention, still in the context of a temperature-compensated technology cap intended to seal a resonant cavity of an OMUX channel. FIG. 5*a* thus shows a flexible cap 1*b*' with two membranes 10', 11' that are banded together whereas FIG. 5*b* shows a flexible cap 1*b*' with two membranes 10', 11' that are screwed together.

It will also be noted that, in FIGS. 2*a*, 2*b*, 3*a*, 3*b*, 4*a*, 4*b*, 5*a*, 5*b*, the various layers 10, 11, 12, respectively 10', 11', are also stacked around a handle 13 which is used to hold them in position.

Figure 6:
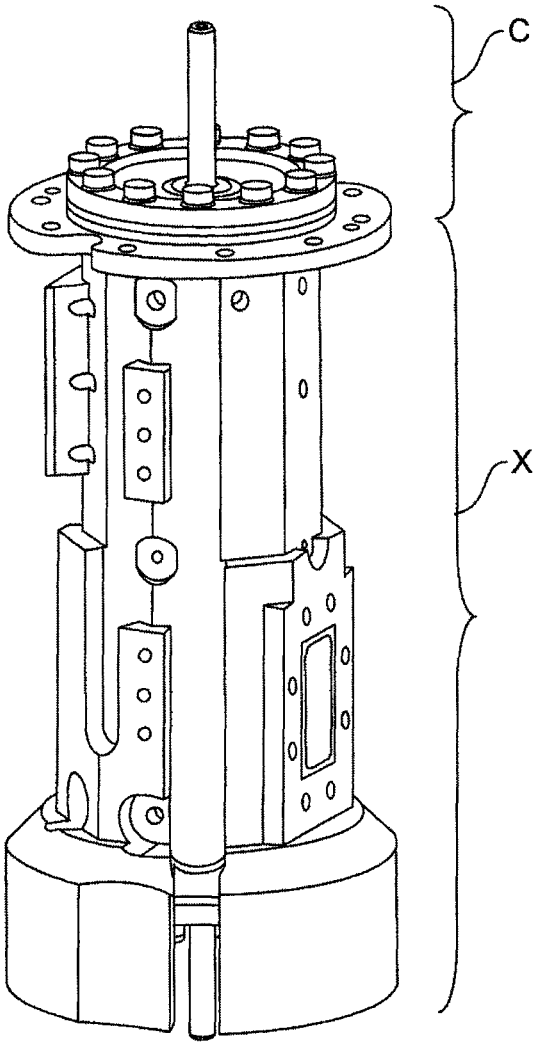
FIG. 6: the three-dimensional representation of a vertical architecture OMUX channel comprising two superposed cavities and two flexible caps conforming to the present invention.

FIG. 6 shows an example of a complete channel according to the invention, comprising a cap consisting of a multiple-membrane flexible wall, the external compensation system not being shown.

To sum up, it can therefore be seen that the use of a multiple-membrane flexible cap makes it possible to:

- reduce the thermal resistance of said cap while maintaining the same level of mechanical stresses exerted on it,
- or, vice versa, reduce the mechanical stresses being exerted on the cap while maintaining an equivalent thermal resistance of said cap,
- or, even, increase the deformation of the flexible wall while maintaining an equivalent level of mechanical stresses, and while maintaining an equivalent thermal resistance.

The direct consequence of this invention is that the field of use of the OMUX is expanded, both in horizontal and vertical configurations:

- in the context of high power OMUXs,
- in the context of a conductive and radiative operating environment that is hot, at around 85° C.,
- in the context of OMUXs that have an electrical configuration with a significant compensation objective.

In another example of an implementation of the invention, a multiple-membrane flexible wall can cooperate with a piston in order to optimize the control of the volume of a resonant cavity, in the context of a temperature-compensation technology suited to filters or OMUXs.

What is claimed is:

1. A flexible wall system for filter component or output multiplexer of thermally-compensated technology, said wall comprising at least two directly stacked distinct flexible membranes, and said flexible membranes each having a central region, an intermediate region and a peripheral region face to face, wherein said flexible membranes are thermally and mechanically coupled directly to one another in the central region and to the peripheral region, and decoupled from one another in the intermediate region.

2. A thermally-compensated technology output multiplexer comprising at least two channels each comprising a resonant cavity sealed by a flexible cap system, wherein said flexible cap consists of a flexible wall according to claim 1.

3. A thermally-compensated technology filter comprising at least one resonant cavity sealed by a flexible cap device, characterized in that said flexible cap consists of a flexible wall according to claim 1.

4. The thermally-compensated technology filter according to claim 3, further comprising a piston cooperating with said membranes so as to allow for optimization of the control of the volume of said resonant cavity.

5. The flexible wall system according to claim 1, wherein said flexible membranes are designed to be distorted simultaneously.

6. The flexible wall system according to claim 5, wherein said flexible membranes are made of a flexible, metallic or non-metallic material.

7. The flexible wall system according to claim 5, wherein said flexible membranes are made of materials that are distinct from one another.

8. The flexible wall system according to claim 5, wherein said flexible membranes are made of aluminum.

9. The flexible wall system according to claim 5, wherein each membrane is made of a combination of distinct materials.

10. The flexible wall system according to claim 5, wherein each flexible membrane is made of a bimetallic strip material.

11. The flexible wall system according to claim 5, wherein said membranes are assembled by at least one of the following methods: screw-fastening; banding; brazing; thermal bonding; electrical welding.

12. The flexible wall system according to claim 5, wherein said flexible wall comprises precisely two membranes.

13. The flexible wall system according to claim 5, wherein said flexible wall comprises precisely three membranes.

14. The flexible wall system according to claim 5, wherein each of said flexible membranes has a thickness of between two and four tenths of a millimetre.

15. The flexible wall system according to claim 5, wherein a temperature-induced deformation of said flexible wall can be obtained by means of a deformation of at least one of said flexible membranes.

16. The flexible wall system according to claim 15, wherein at least one of said flexible membranes comprises a bimetallic strip material, said bimetallic strip material participating in said temperature-induced deformation of the flexible wall.

17. A flexible wall system for a thermally-compensated filter component or output multiplexer comprising:

a wall comprising at least two directly stacked distinct flexible membranes; and the flexible membranes each having a central region, an intermediate region and a peripheral region arranged face to face, wherein the flexible membranes are thermally and mechanically coupled directly to one another in the central region, thermally and mechanically coupled directly to one another in the peripheral region, and not coupled in the intermediate region.

* * * * *